United States Patent [19]

Riblet et al.

[11] Patent Number: 4,463,325

[45] Date of Patent: Jul. 31, 1984

[54] STUB-SUPPORTED COAXIAL POWER DIVIDER HAVING DISSIPATION RESISTOR BURIED IN CENTER CONDUCTOR

[76] Inventors: Gordon P. Riblet, 116 Westgate Rd., Wellesley, Mass. 02181; Henry G. Riblet, 100 W. Cliff Rd., Weston, Mass. 02193

[21] Appl. No.: 408,902

[22] Filed: Aug. 17, 1982

[51] Int. Cl.[3] ..... H01P 5/12

[52] U.S. Cl. ..... 333/127; 333/136; 333/244

[58] Field of Search ..... 333/127, 244, 243, 245, 333/115, 136, 128

[56] References Cited

U.S. PATENT DOCUMENTS

| | | | |
|---|---|---|---|
| 2,714,706 | 8/1955 | Masters | 333/127 |
| 3,422,377 | 1/1969 | Vient | 333/128 X |
| 4,365,215 | 12/1982 | Landry | 333/127 |

OTHER PUBLICATIONS

Ragan, G. L., *Microwave Transmission Circuits,* N.Y., McGraw Hill, 1948, pp. 516–519.

Barrett, R. M. "Microwave Printed Circuits–A Historical Survey", *IRE Transaction on Microwave Theory,* vol. 3, No. 2, Mar. 1955, p. 6.

Webb, R. C. "Power Divider/Combiners: Small Size, Big Spec", *Microwaves,* vol. 20, No. 12, Nov. 1981, p. 67.

*Primary Examiner*—Paul L. Gensler
*Assistant Examiner*—Benny Lee
*Attorney, Agent, or Firm*—Wolf, Greenfield & Sacks

[57] ABSTRACT

A coaxial microwave divider network employing a quarter wavelength long grounded stub for providing support for the center conductor of the divider and also providing improved heat dissipation of the center conductor. Also, this form of stub support permits the center conductor to be supported without a dielectric thereby reducing the insertion loss. Consequently, improved CW power handling performance is possible in comparison with prior designs. Moreover, with the proper choice of the stub admittance level, the input VSWR can also be improved in comparison with a design which employs multi-section matching transformers only at the input.

8 Claims, 9 Drawing Figures

STUB-SUPPORTED COAXIAL POWER DIVIDER HAVING DISSIPATION RESISTOR BURIED IN CENTER CONDUCTOR

BACKGROUND OF THE INVENTION

The present invention relates in general to stub-supported networks and pertains, more particularly, to a stub-supported coaxial microwave divider network.

Microwave divider networks such as a 2-way divider network find many applications in microwave systems. Such networks are commonly constructed in coax or stripline and have a dielectric material for supporting the center conductor. One very common network is schematically illustrated in FIG. 1 herein and employs an input port 1 along with two output ports 2 and 3 with the input port and output ports being interconnected by a 35.4 ohm quarter wavelength long transformer 5. The transformer is employed to provide a match at the input port at mid-band. In the schematic illustration of FIG. 1 each of the ports is a 50 ohm port.

Another prior art network which provides somewhat of an improvement over the one depicted in FIG. 1, is the embodiment illustrated in FIG. 2. In this arrangement there is provided a resistor 6 such as a 100 ohm resistor connected across the region where the transformer connects to ports 2 and 3. In this embodiment the transformer is split into two transmission lines 5A and 5B feeding the respective ports 3 and 2. With the divider network shown in FIG. 1, although the input port is matched, the output ports are not. Furthermore, there is a finite isolation between the output ports at mid-band. Therefore, the resistor 6 is inserted in the embodiment of FIG. 2 so as to provide a perfect output port match and isolation at mid-band.

As indicated previously, the networks illustrated in FIGS. 1 and 2 employ a dielectric material to support the center conductor which is undesirable in that this introduces additional insertion loss due to losses in the dielectric material. Furthermore, in the network of FIG. 2, the resistor is typically soldered on top of a stripline board. The presence of exposed resistive material introduces significant additional loss between the inpput and output ports.

Accordingly, one object of the present invention is to provide an improved microwave power divider network such as a 2-way divider network and which is particularly characterized by reduced insertion loss.

A further object of the present invention is to provide a microwave 2-way power divider network having increased CW power handling capability for a predetermined size network.

Still another object of the present invention is to provide a microwave 2-way power divider network with reduced input VSWR for a given size and bandwidth.

SUMMARY OF THE INVENTION

To accomplish the foregoing and other objects of this invention there is provided a microwave divider network which is preferably constructed in coax, and which comprises means defining an input port with an associated center conductor and means providing two output ports each also having respective center conductors. A transformer conductor interconnects the input port center conductor to two output port center conductors. The divider network also comprises an outer conductor. In accordance with the invention there is provided, in addition to the transformer conductor a stub conductor which extends from the junction of the transformer conductor and the output center conductors, to the outer conductor. The stub conductor provides the primary support for the entire inner conductor construction including support for the transformer conductor. In this way the center conductor is supported without the necessity of any supporting dielectric material with its attendant loss problems.

BRIEF DESCRIPTION OF THE DRAWINGS

Numerous other objects, features and advantages of the invention will become apparent upon a reading of the following detailed description taken in conjunction with the accompanying drawings, in which.

DETAILED DESCRIPTION OF THE DRAWINGS

Figure 1:
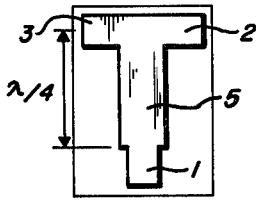
FIG. 1 (PRIOR ART)
FIG. 1 schematically illustrates one version of a prior art microwave divider network.
Figure 2:
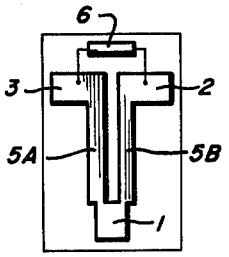
FIG. 2 (PRIOR ART)
FIG. 2 is a schematic diagram illustrating another version of a prior art microwave divider network.
Figure 3:
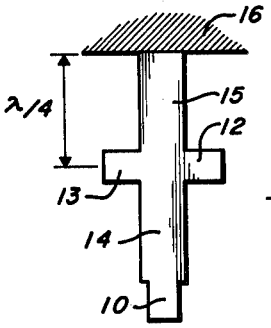
FIG. 3 schematically illustrates the principles of the microwave divider network of the present invention.
Figure 4:
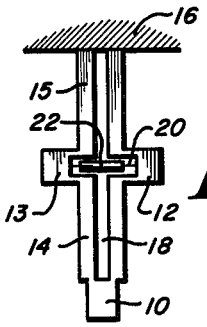
FIG. 4 is a diagram similar to the diagram of FIG. 3 showing an alternate embodiment.

Referring now to the drawings, reference has been made hereinbefore to the prior art divider networks illustrated in FIGS. 1 and 2. FIG. 3 now schematically illustrates a microwave divider network constructed in accordance with the principles of this invention. The divider network depicted may be of the type that provides equal power division. The divider network generally comprises a center conductor and an outer conductor. FIGS. 3 and 4 represent the network schematically while the details of one form of the invention are disclosed in FIGS. 5–8. In accordance with one embodiment of the invention the center conductor may be in the form of a solid rectangular line while the outer conductor may also have a rectangular shape. In accordance with another version the inner and outer conductors may be square. For example, for a 50 ohm line suitable for attaching to SMA connectors, it is convenient to construct the inner and outer conductors square. For example, the inner conductor may be 0.060 inch×0.060 inch while the outer conductor may be 0.150 inch×0.150 inch. In the embodiment of FIG. 3 it may be assumed that the inner and outer conductors are both square and may be of the aforementioned dimensions. In FIG. 3 the input 50 ohm line at port 10 is connected to the two output port 50 ohm lines at ports 12 and 13 by a preferably rectangular transforming line 14 which is a one-quarter wavelength long at mid-band.

The width of this transforming line 14 may be selected to give an impedance of less than 35.4 ohms so that the input port is matched at two frequencies centered at mid-band. A fourth line 15 extends from the junction of the transformer 14 with the lines at the ports 12 and 13. This line 15 preferably has a characteristic impedance about the same as that of the transforming section. Also, the stub-line 15 is one-quarter wavelength long at mid-band and terminates at a wall 16 of the outer conductor. The line 15 serves the dual function of providing a mechanical support for the inner conductor and also providing improved input port matching. With regard to the impedance of the transformer 14 and the stub line 15, reference may be made to U.S. Pat. No. 4,041,420 which discloses the use of a resident stub for improving the input port match of a 2/1 transformer.

The divider network illustrated in FIG. 3 schematically depicts the principles of this invention. However, this particular divider network does have some drawbacks such as poor output port match and poor output port isolation. It is presently known that resistors, such as the resistor employed in FIG. 2 may be used to improve match and isolation properties. A detailed treatment is given by Seymour P. Cohn, "A Class of Broadband Three-Port TEM-Mode Hybrids", IEEE Trans. on MTT, Vol. MTT-16, pp. 110–116, February, 1968.

In FIG. 2 discussed hereinbefore, in a stripline version, a slot is cut along the middle of the transformer dividing it into two transmission lines illustrated in FIG. 2 as lines 5*a* and 5*b*. A 100 ohm resistor 6 is connected across these two lines where they connect to the output lines. It can be shown that in this case both the even and odd mode reflection coefficients are zero at mid-band and consequently all ports are matched at mid-band and there is infinite isolation between the output ports at mid-band. The same result is achieved in the embodiment in accordance with the present invention of FIG. 4 in which there is shown an input port 10 and output ports 12 and 13. Both the transformer conductor 14 and stub conductor 15 have a common slot 18 extending therealong. This slot 18 extends from the start of the transformer at the input port 10 to the end of the stub conductor 15 where it connects to the outer conductor at wall 16. A small cross slot 20 is illustrated in FIG. 4 and is formed essentially at the point where the four lines join. A 100 ohm resistor 22 is inserted in the slot 20. The resistor 22 is essentially buried within the metallic center conductor and thus it contributes very little additional insertion loss in contrast to the exposed resistor in the stripline version illustrated in FIG. 2. Moreover, because the center conductor is heat sunk to the outer conductor by virtue of the stub 15, the CW power handling capability is substantially increased. Reference is also made hereinafter to FIG. 9 which shows further detail of an embodiment incorporating the resistor schematically illustrated in FIG. 4.

Figure 5:
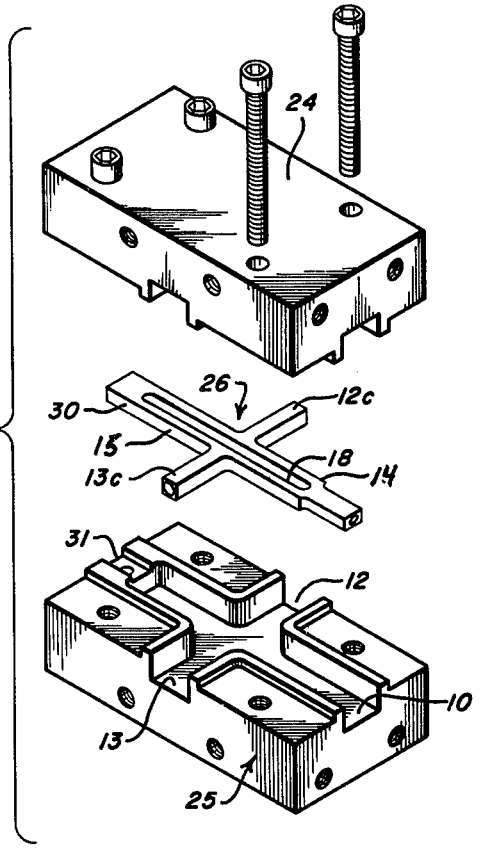
FIG. 5 is an exploded view showing a more detailed construction for a microwave divider network constructed in accordance with the principles of the present invention.
Figure 6:
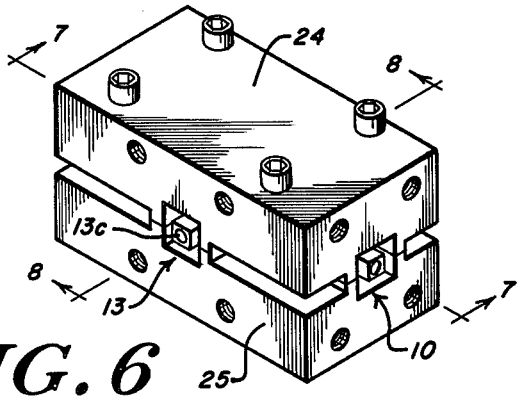
FIG. 6 is a perspective view showing the network of FIG. 5 in its assembled state.

FIGS. 5–8 now illustrate in detail one embodiment of the present invention including outer conductor halves 24 and 25 and an inner conductor structure 26. The outer conductor has each of its halves slotted. When the halves are joined as illustrated in FIG. 6, the slots in the halves define the input port 10 and the output ports 12 and 13.

Figure 7:
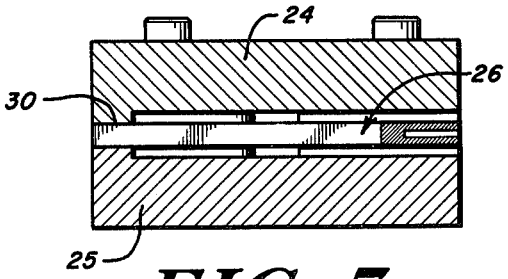
FIG. 7 is cross-sectional view taken along lines 7—7 of FIG. 6.
Figure 8:
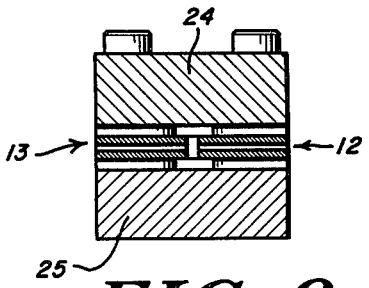
FIG. 8 is a cross-sectional view taken along lines 8—8 of FIG. 6.

The center conductor member 26 has a transformer line 14 with the slot 18 extending partially therealong. The slot 18 extends also into the stub line 15 as illustrated in FIG. 5. The end 30 of the line is held within a relatively small slot 31 formed between the upper and lower outer conductor halves 24 and 25. FIG. 5 also shows the side conductors 12*c* and 13*c* which are center conductors that couple to the respective output ports 12 and 13. FIG. 6 illustrates, for example, the center conductor 13*c* at the output port 13. It is noted that the center conductor is spaced from the outer conductor. In the embodiment illustrated the total support for the center conductor is at the end 30 of the stub support. FIGS. 7 and 8 also illustrate the spaced support of the center conductor from the outer conductor except at the single point support at the end 30 of the stub conductor. This mode of support allows the center conductor to be supported without a dielectric thereby reducing the insertion loss. As a consequence, improved CW power handling performance is possible in comparison with conventional designs. The grounded stub 15 also improves the heat dissipation of the center conductor.

Figure 9:
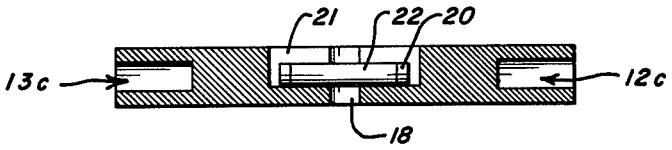
FIG. 9 is a cross-sectional view of an alternate variation in the construction of the divider network of this invention incorporating a resistor disposed in a cross-slot of the center conductor.

In an alternate embodiment of the invention, as now shown in the detailed cross-sectional view of FIG. 9, the center conductor member 26 is provided with a cross-slot 21 for accommodating a resistor 22. This construction is similar to that previously discussed with regard to the schematic diagram of FIG. 4. The cross-slot 21 extends on opposite sides of the slot 18 and extends into the center conductors 12*c* and 13*c*, respectively. The resistor has terminals at its ends which may be silver epoxied as indicated at 20 for connection to the respective center conductors 12*c* and 13*c*. It is also noted in FIG. 9 that the resistor 22 is essentially buried within the metallic center conductor and in this way it contributes very little additional insertion loss in contrast to the exposed resistor in the strip-line version illustrated hereinbefore in FIG. 2.

Having described a limited number of embodiments of the present invention, it should now be apparent to those skilled in the art that numerous other embodiments are contemplated as falling within the scope of this invention. For example, in FIG. 5 the support end 30 is shown solid but could also be slotted as illustrated in FIG. 4 with the slot 18 simply extending through the end 30. However, the solid support construction of FIG. 5 is preferred in that this provides for a more rigid support of the center conductor member.

What is claimed is:

1. A microwave divider network comprising;

means defining an input port having an associated input port center conductor, means defining two output ports each also having associated respective center conductors, a transformer conductor connecting the input port center conductor to the two output port center conductors, an outer conductor, a stub conductor which extends from the junction of the transformer and output center conductors to the outer conductor, said stub conductor and transformer conductor being linearly contiguous and having an elongated slot extending therebetween defined by slot side walls, one slot side wall adjacent one output port center conductor and the other slot side wall adjacent the other output port center conductor, a resistor having a pair of terminals, means conductively connecting one resistor terminal to one slot side wall, and means conductively connecting the other resistor terminal to the other slot side wall, said slot having a depth greater than the height of the resistor so that the resistor does not extend out of the slot so as to thereby contribute very little additional insertion loss.

2. A microwave divider network as set forth in claim 1 wherein the resistor is disposed across the middle of the slot.

3. A microwave divider network as set forth in claim 2 wherein said conductors are rectangular in shape.

4. A microwave divider network as set forth in claim 2 wherein said resistor has a value of 100 ohms.

5. A microwave divider network as set forth in claim 2 wherein there is provided equal power division.

6. A microwave divider network as set forth in claim 2 wherein the transformer and stub conductors are one-quarter wavelength long at mid-band and provide for an impedance less than 35.4 ohms.

7. A microwave divider network as set forth in claim 2 including a main slot and a cross-slot and wherein said resistor is disposed within the cross-slot.

8. A microwave divider network as set forth in claim 7 wherein the resistor lies below the metallic surface of the center conductor thereby essentially being buried within the center conductor.

* * * * *